252-149 AU 166 EX
7/18/78 XR 4,101,339

United States Patent [19]
Kaneko et al.

[11] 4,101,339
[45] Jul. 18, 1978

[54] TREATMENT OF ZINC SURFACES

[75] Inventors: Hideaki Kaneko, Tokyo; Yasushi Miyazaki, Ichikawa; Masanori Suzuki, Tokyo, all of Japan

[73] Assignee: Oxy Metal Industries Corporation, Warren, Mich.

[21] Appl. No.: 827,660

[22] Filed: Aug. 25, 1977

[30] Foreign Application Priority Data

Sep. 2, 1976 [JP] Japan ..... 51-104249

[51] Int. Cl.[2] ..... C03C 23/00
[52] U.S. Cl. ..... 134/2; 134/3; 134/41; 252/149
[58] Field of Search ..... 134/2, 3, 41; 252/149

[56] References Cited

U.S. PATENT DOCUMENTS

| | | | |
|---|---|---|---|
| 2,050,355 | 8/1936 | McCollam et al. | 134/41 |
| 2,959,555 | 11/1960 | Martin et al. | 134/3 X |
| 3,294,695 | 12/1966 | Tippett | 252/149 |
| 3,468,804 | 9/1969 | Perry | 134/41 X |

FOREIGN PATENT DOCUMENTS

| | | | |
|---|---|---|---|
| 2,108,294 | 10/1972 | Fed. Rep. of Germany | 134/3 |

*Primary Examiner*—Arthur D. Kellogg
*Attorney, Agent, or Firm*—Arthur E. Kluegel; Bertram F. Cleeboe; Richard P. Mueller

[57] ABSTRACT

An improved chromium-free zinc surface treatment provides for contacting the surface with an aqueous solution of a thiourea compound and a vegetable tannin at a pH value of from 2 to 6.5. Corrosion resistance and paint receptivity of the surface are enhanced.

6 Claims, No Drawings

TREATMENT OF ZINC SURFACES

BACKGROUND OF THE INVENTION

This invention relates to the art of metal treatment. More specifically, it relates to the art of treating a zinc or zinc alloy surface to improve corrosion resistance and paint receptivity.

Conventionally, zinc is employed to provide corrosion resistance to steel via electro or hot-dip galvanizing. However, a zinc surface tends to produce white rust when it is in an atmosphere with high humidity. Therefore, the appearance deteriorates, and the ability to protect the base material from rust decreases.

As a conventional means of protection against white rust, a chromate treating method is practiced. In this method, chromic acid, dichromic acid and the salts of these acids are used as the main treating agents. However, the toxic effects of hexavalent chromium and the problems of environmental pollution have made elimination of chromate usage desirable. The standards for operating and safety control, such as use of the salts and treatment of waste water had become more strict, and a treating method that can take place of the chromate method is desirable.

Conventionally, the method of preventing corrosion or improving the paint receptivity by treating the metal surface, with tannic acid is well known. (For example, Patent Bulletin 1976–2902), and many theories on rust proof by tannin are presented. (For example, Mihara, Kazuyuki, *Journal of Association of Coloring Material.* Vol. 37. No. 2, P., 62, 1964; E. Knowles and T. White. *Journal of the Oil Color Chemistry Association.* Vol. 41, P. 10, 1956.) However, when hot-dip galvanized panels are treated in tannic acid, the appearance is adversely affected because the metal luster is decreased and corrosion resistance is sub-standard. When the panel is treated in a solution of pH 6.5–9.0, the change in surface luster is relatively small, but there is little improvement in corrosion resistance because the reaction of tannin in such solution is weak. Generally, when the pH of the treating solution is in a range higher than 7.0, the tannin or tannic acid in the treating solution will decompose.

It is known that when zinc or zinc alloy is treated to improve corrosion resistance by the chromate method, processed by pressing or bending, and painted, the chromate film on the surface will provide good corrosion resistance, but the adhesion of paint to the surface and/or the scratch resistance are worse than those obtainable by phosphate treatment. Oftentimes, the zinc surface may be chromate treated to provide short-term bare corrosion resistance during storage or shipping. If the treated part is ultimately to be painted, it may be necessary to first remove the chromate film before phosphate treating.

When there is a chromate film on a zinc or zinc alloy surface, the action of the phosphoric acid treatment is inhibited so that little phosphate film forms. Therefore, when the phosphoric acid method is to be used to form a film, it is necessary to first remove the chromate film by either a physical method or chemical method. Buff-polishing is one of the physical methods employed, and treating the material in an alkaline solution of potassium permanganate is one chemical method. By either method, complete removal of the chromate film is difficult, and there remains the problem of pollution caused by the removed chromates.

SUMMARY OF THE INVENTION

It has now been discovered that an aqueous chromium-free composition containing a thiourea compound and a vegetable tannin may be employed to treat a zinc or zinc alloy surface to provide improved corrosion resistance and/or paint receptivity. If desired, the film formed by this treatment may be readily removed via alkaline cleaner to permit subsequent phosphate treatment.

DETAILED DESCRIPTION OF THE INVENTION

Thiourea compounds useful in the present invention include thiourea itself and derivatives thereof such as alkyl thiourea, e.g., dimethyl thiourea, diethyl thiourea, etc., guanyl thiourea and the like in a concentration from 1 to 90 g/l, preferably from 5 to 50 g/l. In general, suitable for use in the invention are thiourea compounds having the general formula:

$$X_2N\overset{\overset{\displaystyle S}{\|}}{C}NX_2$$

wherein each X is independently selected from the group consisting of hydrogen and alkyl and amidino groups of up to 4 carbon atoms. Substantially no effect will be achieved at a concentration of lower than 1 g/l. On the other hand, a concentration of higher than 90 g/l achieves no further improvement in results and may cause solubility problems.

Tannin or tannic acid usable in the present invention may be any vegetable tannin, hydrolyzable or condensed, and may be partially hydrolyzed. Suitable tannins include depside tannin, gallotannin, chinese tannin, turkish tannin, hamamelitannin, tannic acid from acer ginnala, chebulinic acid, sumac tannin, chinese gallotannin, ellagitannin, catechin, catechin-tannin, and quebracho-tannic acid. The tannin may be used in a concentration from 5 to 200 g/l, preferably from 10 to 100 g/l.

The weight ratio of thiourea to tannin may range from 10 : 1 to 1 : 10, preferably from 3 : 1 to 1 : 3.

If the ratio of thiourea to tannin deviates markedly from the range of 10 : 1 to 1 : 10, blisters in subsequently painted film tend to be formed in the aqueous corrosion test.

The pH range of the treating solution according to the present process depends on the type of tannin, method and conditions of the application and the like but normally ranges from 2 to 6.5, preferably from 2.5 to 6.5. If the pH is higher than 6.5, reaction rate is inhibited, but if lower than 2, the reaction may occur too violently and adversely affect surface appearance. In order to adjust the pH of the treating solution, any commonly employed acidic or alkaline material may be used. Suitable acidic materials include inorganic acidic materials such as phosphoric acid, nitric acid, sulfuric acid, hydrofluoric acid, hydrochloric acid and the like and salts thereof and organic acidic materials such as oxalic acid, citric acid, malic acid, maleic acid, phthalic acid, lactic acid, tartaric acid, choloroacetic acid, acrylic acid and the like and salts thereof. Alkaline materials include inorganic and organic bases such as sodium hydroxide, potassium hydroxide, lithium hydroxide and the like, ammonia and amines such as ethylamine, diethylamine, triethylamine, ethanolamine and the like.

The following examples illustrate the invention:

EXAMPLE 1

A hot-dip galvanized steel panel (100 × 100 × 0.3 mm) was polished using the wet buff method (the board had been previously treated in chromic acid for corrosion protection); when the galvanized panel was clean and after the chromate was removed from the surface, it was dipped in the treatment solution for 3 seconds at 60° C. To prepare the treatment solution, 50 g. gullnut tannin (brand name-Tannic Acid AL supplied by Fujikagaku Kogyo) and 10 g/ thiourea were dissolved in deionized water, and the total valume of the solution was brought to one liter and its pH was adjusted to 3.5. After dipping, the panel was dried for 30 seconds at 120° C. in a hot air circulating oven. Using this panel, the salt water spray test based on JIS-Z-2371 was conducted, and the results are shown in Table 1.

COMPARISON EXAMPLE 1A

An identical panel was treated in the same manner as in Example 1 except the treatment solution for this comparison example was prepared by dissolving 50 g of gullnut tannin in one liter deionized water and adjusting pH to 3.5.

COMPARISON EXAMPLE 1B

As a control, a cleaned-only panel was subjected to salt spray testing.

EXAMPLE 2

Panels treated as in Example 1 and Comparison Examples 1A and 1B, were painted via draw-down bar. The paint used was a zinc alkyd resin type paint. In a hot air circulating oven at 280° C, the panels were cured for 50 seconds, and a film of approximately 6 microns in thickness was formed on each panel. The salt spray test based on JIS-Z-2371 was conducted for 240 hours, and the painted surface was washed with water. Then cellophane adhesive tape was pressed against the surface, and stripped away rapidly. The peeling of the paint on the surface was observed, and the results are shown in Table 2.

EXAMPLE 3

Test panels were prepared in the same manner as in Example 2 and were dipped in boiling water for 2 hours. The peeling of the paint on the surface was observed in the same manner as Example 2, and the results are shown in Table 3.

EXAMPLE 4

Panels were treated as in Example 2 except the paint used was an alkydmelamine type paint (brand name - Amirakku No. 3 White by Kansai Paint Co.). It was cured for 30 minutes in a hot air circulating oven at 90° C, and a film of paint with 25±2 microns in thickness was formed on each panel. The adhesion of the film was tested as described below and the results are shown in Table 4.

TABLE 1

| | Bare Corrosion Resistance | | | |
|---|---|---|---|---|
| | Surface | Salt Spray Test Results | | |
| Panel | Appearance | 24 hrs. | 48 hrs. | 72 hrs. |
| Example 1 (thiourea & tannin) | Colorless, transparent | Nil | Nil | 5% white rust |
| Comparison Ex. 1 (tannin only) | Milk-White | Nil | 5% white rust | 50% white rust |
| Comparison Ex. 2 (cleaned only) | — | 100% white rust | — | — |

TABLE 2

| | Painted Corrosion Resistance | |
|---|---|---|
| | Salt Spray Test Results | |
| Panel | Blister Appearance | Paint Removed by Tape Pulling |
| Example 2 | Nil | Nil |
| Comparison Ex. 2A | Small Blisters over surface | Minor peeling |
| Comparison Ex. 2B | Large blisters over surface | Major peeling |

TABLE 3

| | Painted Corrosion Resistance | |
|---|---|---|
| Board Tested | Blister Appearance | Paint Removed by Tape Pulling |
| Example 3 | Nil | Nil |
| Comparison Ex. 3A | Small blisters over entire surface | Minor peeling |
| Comparison Ex. 3B | Large blisters over entire surface | Major peeling |

TABLE 4

| | Film Close Adhesiveness | | |
|---|---|---|---|
| Board Tested | Checkerboard Test | Bending Test | Impact Test |
| Example 4 | 100/100 | No peel | Peeling less than 10% |
| Comparison Ex. 4A | 100/100 | Slightly Peeled | 25% peeled |
| Comparison Ex. 4B | 80/100 | Peeling all over | Peeling all over |

TEST METHODS (1) Checkerboard Test

The painted surface of the panels was cross-hatched with a knife to form a checkerboard. Each small square in the checkerboard has the size of 1 sq. mm, and the scratch is of depth to reach to the base metal. Cellophane adhesive tape was then applied to the checkerboard and pulled and % paint remaining measured.

(2) Bending Test

The panels were subjected to a 180° bend. Cellophane adhesive tape was applied to the bend and paint adhesion at the bend was observed.

(3) Impact

The panels were subjected to impact and peeling of the painted surface was tested by using cellophane adhesive tape on the reverse or convex surface.

Diameter of center of impact: ½ inch, weight: 500 g

Falling distance: 50 cm

Tables 1, 2, 3 and 4, each demonstrates the superior corrosion resistance or paint receptivity obtained in accordance with the invention. It is far better than the results of panels treated in the tannin only solution (Comparison Examples A) or the cleaned-only panel (Comparison Examples B).

What is claimed is:

1. A process for improving the corrosion resistance and paint receptivity of a zinc or zinc alloy surface comprising contacting the surface with an aqueous composition containing a thiourea compound and a vegetable tannin and exhibiting a pH value of from 2 to 6.5.

2. The process of claim 1 wherein the thiourea compound has the formula:

$$X_2N\overset{\overset{\displaystyle S}{\|}}{C}NX_2$$

Wherein each X is independently selected from the group consisting of hydrogen, and alkyl and amidino groups of up to 4 carbon atoms.

3. The process of claim 2 wherein the thiourea compound is selected from the group consisting of thiourea, dimethyl thiourea, diethyl thiourea and guanyl thiourea.

4. The process of claim 1 wherein the concentration of the thiourea compound is from 1 to 90 g/l.

5. The process of claim 1 wherein the vegetable tannin is selected from the group consisting of depside tannin, gallotannin, chinese tannin, turkish tannin, hamamelitannin, tannic acid from acer ginnala, chebulinic acid, sumac tannin, chinese gallotannin, ellagitannin, catechin, catechin-tannin, and quebracho-tannic acid.

6. The process of claim 1 wherein the concentration of the vegetable tannin is from 5 to 200 g/l.

* * * * *